US006726052B1

(12) United States Patent
Miller

(10) Patent No.: US 6,726,052 B1
(45) Date of Patent: Apr. 27, 2004

(54) COLLAPSIBLE FLUID TRANSPORT TANK

(75) Inventor: Leo P. Miller, Roseville, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/392,483

(22) Filed: Mar. 19, 2003

(51) Int. Cl.[7] ..... B68D 88/12
(52) U.S. Cl. ..... 220/666; 220/723
(58) Field of Search ..... 220/666, 723, 220/720

(56) References Cited

U.S. PATENT DOCUMENTS 3,802,464 A * 4/1974 Frank et al. ..... 138/30
4,875,596 A * 10/1989 Lohse ..... 220/1.6
6,129,236 A * 10/2000 Osokin et al. ..... 220/723
6,401,966 B2 * 6/2002 Tsai ..... 220/723

* cited by examiner

*Primary Examiner*—Joseph Man-Fu Moy
(74) *Attorney, Agent, or Firm*—David L. Kuhn; Gail S. Soderling; Clifford C. Carter

(57) ABSTRACT

A flexible container for the transportation of fluids having means to keep the container in a sufficiently rigid shape that it can be moved and handled using conventional techniques until empty at which time the container can be collapsed for ease of shipment and storage.

2 Claims, 1 Drawing Sheet

COLLAPSIBLE FLUID TRANSPORT TANK

GOVERNMENT INTEREST

The invention described here may be made, used and licensed by The United States Government for governmental purposes without paying me any royalty.

BACKGROUND OF THE INVENTION

In one aspect this invention relates to collapsible containers. In yet a further aspect this invention relates to fuel transport means.

Modern military operations require the use of substantial amounts of fuel. Even though the fuel capacity of most military vehicles is substantial, the vehicles high rate of fuel consumption limits the distance they can travel without refueling. In order to extend the military range it is necessary to carry additional fuel to the vehicles.

The military has adopted the use of various sized collapsible containers such as flexible bladders which can be collapsed in order to return them to a refueling port once they've been emptied. However, under current operating conditions use of bladders is restricted to either fully loaded or fully collapsed because the present bladder structure loses its form and stability whenever the bladder is partially emptied. Thus, a bladder which has had any quantity of fuel removed cannot be moved, transported or stored. Because of this problem, the convenient and useful collapsible vessels have been relegated to a secondary role in favor of various rigid walled vessels. The non collapsible storage containers require substantially more space for shipment and storage when empty and increase the logistics requirements when compared to collapsible bladders or containers.

It would be desirable to have a collapsible fluid handling system which can be transported, stored, and moved in a partially filled condition. Such vessels could increase the mission effectiveness by allowing use of standard equipment handling procedures of the type normally provided for the use of a rigid type containers. This would significantly reduce liquid transport cost and minimize the empty weight of the containers that must be handled.

SUMMARY OF THE INVENTION

The present invention provides a fluid transport container that solves the problems of the prior art structures to form a collapsible fluid transport mechanism. The structure of this invention has a flexible, inner containment bladder suitable for holding the fluid to be transported. Associated with this containment bladder will be means for filling and withdrawing the fluid in the containment bladder. An outer transport bladder surrounds and encloses the inner containment bladder. There are means associated with the transport bladder to insert a pressurized gas, such as air, within any space between the inner surface of the transport bladder and the outer surface of the containment bladder. The pressurized gas is maintained at a pressure sufficient to keep the transport bladder's shape and rigidity at a level that allows movement and transportation using conventional transportation techniques. The transport bladder has handling means attached to its outer surface which can be used for attaching cargo hold downs to hold the container in position or can be used to lift and move the container.

A major advantage of this system is the ability to ship the empty containers in a collapsed condition. When collapsed, the containers will consume less volume making for a decreased logistics burden. When a collapsed container reaches a fuel transportation point it can be filled with the fluid to be transported and then placed on a vehicle to be transported to the final destination. The gas pressure maintenance feature will replace the volume of fluid removed form the containment bladder with the required volume of gas at a pressure that keeps the container transportable until the containment bladder is substantially completely emptied at which time the whole container can be collapsed for shipment to its desired location.

The advantages of the inventive transport container will allow it to accompany combat vehicles extending their range well beyond that of their on board fuel supplies. As fuel is consumed the present container will become lighter and consume less energy to transport when compared to tankers where the container has a substantial unloaded weight. This further increases the efficiency and range. Once the transport container is empty it will have only modest weight compared to other rigid containers so it can be cheaply returned for refilling.

DETAILED DESCRIPTION

Figure 1:
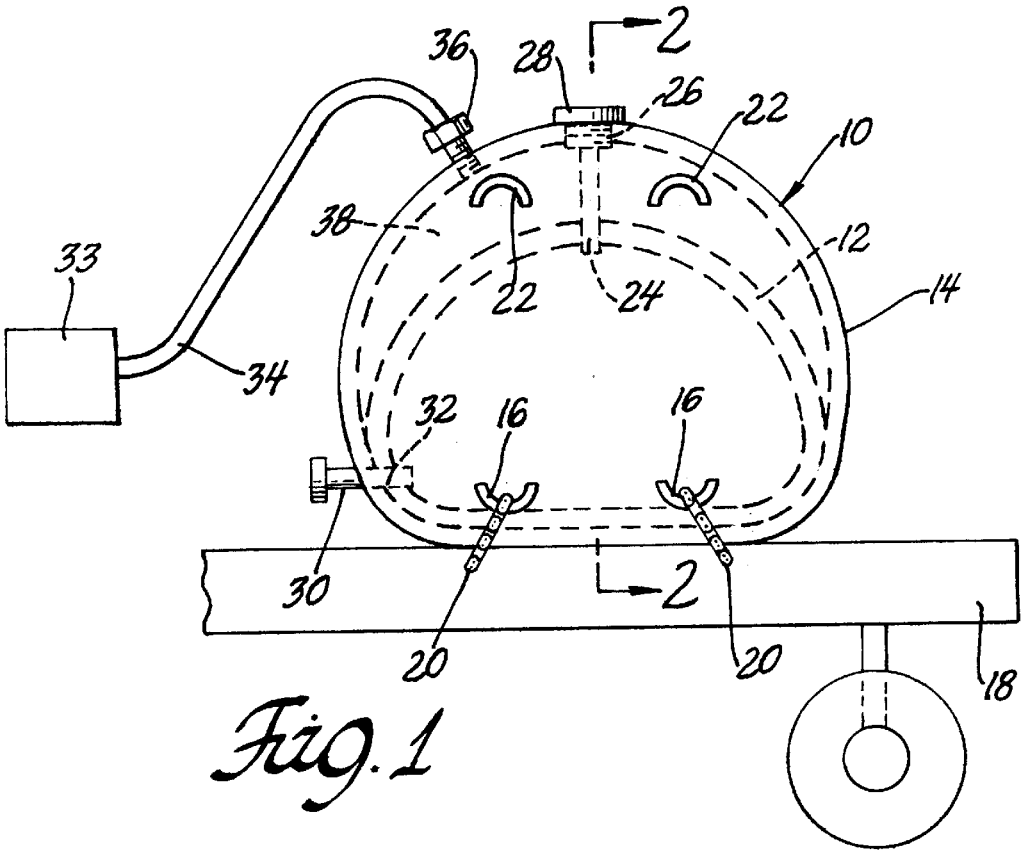
FIG. 1 is a side view of one embodiment of a container according to this invention on a truck.
Figure 2:
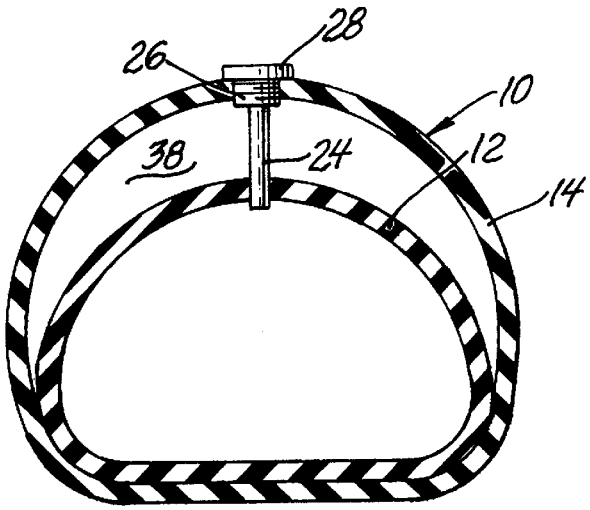
FIG. 2 is a sectional view of the structure of FIG. 1 taken along the line 2—2.

Referring to the accompanying drawing wherein like numerals refer to like parts, The fluid transport container according to this invention is designated generally 10. In the interior of transport container 10 is a flexible, inner containment bladder 12 suitable for holding a fluid to be transported. The inner containment bladder 12 can be formed of well known materials one example being neoprene synthetic rubber which can hold most types of fluids carried by the military. The inner, containment bladder 12 can also be made from a fluid tight, coated fabric. An outer transport bladder 14 surrounds and encloses the inner containment bladder 12. The outer transport bladder 14 provides additional support for the transport container 10 when loaded and will generally be formed of gas and liquid impermeable material suitable for the fluid being transported. Like the inner containment bladder 12, the transport bladder 14 can be made of fluid impermeable coated fabric or a synthetic rubber such as neoprene. The transport bladder 14 may also be formed as a multi-layer flexible laminated structure with a wear resistant outermost surface and a gas impermeable inner surface. A laminated transport bladder 14 would allow the vessel to have a strong wear resistant fabric on the outer surface to protect the bladder from puncture and abrasion while the inner lamella can be made from a material for the gas containment aspect of protection. The transport bladder 14 will have handling devices 16 attached to its outer surface. As shown in FIG. 1 there are two devices located on the lower portion of the transportation bladder 14 that are connected to a flat bed 18 of a truck by means of chains 20. The chains 20 or other well known hold down devices are used during transport to hold the transport container 10 firmly on the flat bed 18. Upper lifting devices 22 can be used with slings, hooks or other crane mounted lifting means to move the transport container 10 onto and off of the flat bed 18. The upper lifting devices 22 can also be used to load and unload transport containers 10 from ship's holds and the like.

The containment bladder 12 has a filler tube 24 with an inlet 26 mounted in the transportation bladder 14 and closed by means of a cap 28. The filler tube 24 is sized and flexible so that as the fluid level in the containment bladder 12 changes causing the containment bladder to expand and contract the filler tube remains connected. The containment bladder 12 has fluid outlet 30 mounted in the transportation bladder 14 with a flexible connector tube 32 providing fluid connection between the outlet and the containment bladder 12. The outlet 30 shown is of a simple tube and nozzle design other fluid extraction means be known in the art and easily incorporated, one example being a siphon structure. Pumping structures are also contemplated as being within the scope of this invention.

When the containment bladder 12 is completely filled, the pressure of the fluid, particularly if it is a liquid, will provide a degree of rigidity to the over all structure. However as fluid is withdrawn from the containment bladder 12, this rigidity is compromised since both the transportation bladder 14 and containment bladder 12 are collapsible. The transportation container 10 of this invention has means associated with the transportation bladder 14 to supply pressurized gas to the interior of the transportation bladder 14 to maintain a predetermined internal pressure in the space between the inner surface of the transport bladder and the outer surface of the containment bladder 12. The pressure supplied will be at a level sufficient to maintain the transportation bladder's 14 shape and rigidity that allows movement and transportation using the same conventional transportation techniques used when the bladder is full of fluid.

As shown, the transportation bladder 14 is attached to a compressor 33 by means of a line 34 at a valve 36 located on the upper surface of the transportation bladder. In its simplest configuration, the valve 36 will be a check valve that is responsive to a lowered pressure in the space 38 between the transportation bladder 14 and the containment bladder 12 to allow high pressure air from the compressor 33 into the space and maintain the pressure at the predetermined level that keeps the transportation bladder 14 properly inflated. Once the fluid in the containment bladder 12 has been exhausted, the check valve 36 can be vented to the ambient atmosphere allowing the transportation bladder to collapse and the resulting collapsed structure stacked with other exhausted items for shipment to a refilling center.

The compressors commonly found on trucks with sir brakes and those which are part of the military fleet, have a normal operating pressure of about 65 to 130 psi. As fluid is removed from the inner containment bladder 12 the compressor 33 will begin to fill the resulting space 38 with compressed air to maintain the transport bladder's configuration. The compressor continues until the transport bladder 14 is pressurized to the point where the transport container 10 can be safely moved. In general a 65 to 85 psi should be sufficient. However if the transport container 10 is not sufficiently rigid, at these pressures additional air can be inserted until the transport container has sufficient rigidity to be safely moved.

Various alterations and modifications will become apparent to those skilled in the art without departing from the scope and spirit of this invention and it is understood this invention is limited only by the following claims.

What is claimed is:

1. A collapsible fluid transport container comprising:

a flexible containment bladder holding a quantity of fluid to be transported;

means for controlling the fluid level in the containment bladder;

a transport bladder surrounding the containment bladder;

means for supplying compressed air to the transport bladder in response to the withdrawal of fluid from the containment bladder to maintain sufficient pressure in the transport bladder to retain its shape and rigidity when there is a fluid in the fluid bladder; and securing means attached to an outer surface of the transport bladder for use in moving and securing the container to a transport mechanism.

2. The transport container of claim 1 further comprising means for transferring fluid from the flexible containment bladder to a vehicle.

* * * * *